United States Patent [19]

Izumi et al.

[11] 3,950,975

[45] Apr. 20, 1976

[54] PROCESS OF COLD PLASTIC DEFORMATION OF METALS

[75] Inventors: Kaichi Izumi, Tokyo; Hiroshi Kono, Funabashi, both of Japan

[73] Assignee: Kao Soap Co., Ltd., Tokyo, Japan

[22] Filed: June 7, 1974

[21] Appl. No.: 477,512

Related U.S. Application Data

[63] Continuation of Ser. No. 403,084, Oct. 3, 1973, abandoned.

[30] Foreign Application Priority Data

Oct. 11, 1972 Japan ..... 47-101780

[52] U.S. Cl. ..... 72/42; 72/46; 252/56 R; 252/59

[51] Int. Cl.[2] ..... B21B 45/02; B21J 3/00; B21D 22/00

[58] Field of Search ..... 106/270; 72/41, 42, 72/46; 252/52 R, 56 R, 59

[56] References Cited

UNITED STATES PATENTS

| | | | |
|---|---|---|---|
| 2,523,848 | 9/1950 | Schaerer et al. | 106/270 |
| 2,755,193 | 7/1956 | Rumberger | 106/270 |
| 3,267,037 | 8/1966 | Mitacek et al. | 252/59 |
| 3,298,954 | 1/1967 | Brown | 252/59 |

FOREIGN PATENTS OR APPLICATIONS

| | | | |
|---|---|---|---|
| 493,524 | 10/1938 | United Kingdom | 252/52 R |

*Primary Examiner*—C. W. Lanham
*Assistant Examiner*—E. M. Combs
*Attorney, Agent, or Firm*—Woodhams, Blanchard and Flynn

[57] ABSTRACT

A composition is disclosed for coating metal prior to cold plastic deformation working, consisting of 95 to 20 wt. % of a di-long chain aliphatic hydrocarbon ketone and 5 to 80 wt. % of a solid paraffin; said composition having a low coefficient of friction, good spreading properties, good anti-rust properties, good rolling properties and good welding and soldering properties. The composition can optionally contain minor proportions of (1) polybutene, (2) lecithin and (3) dialkyl phthalates or dialkyl adipates.

4 Claims, No Drawings

PROCESS OF COLD PLASTIC DEFORMATION OF METALS

This is a continuation of application Ser. No. 403,084, filed Oct. 3, 1973, now abandoned.

BACKGROUND OF THE INVENTION

FIELD OF THE INVENTION

The present invention relates to a process of cold plastic deformation of metals in which special compositions are applied to the surface of a metal object such as a plate or sheet prior to mechanical forming or working (such as rolling, stamping or pressing). It relates therefore to agents that assist in the plastic working of metals, broadly referred to herein as plastic working agents for metals. The term "cold plastic deformation" is used herein to refer to the working of metals that have not been subjected to a heat preparation step.

Coatings have been applied to the surface of metal objects such as plates or sheets, particularly those made of steel to prevent impairment of the surface caused by friction between the surface and the shaping means, e.g. rollers or dies, and to protect the metal object from excess local temperature elevations, e.g., hot spots, or burning. Moreover, a hydrocarbon oil coating, often the same as or similar to the above coating is applied after forming or working to prevent rusting or oxidation of the surfaces during storage or transportation. The thus coated rolled sheet or plate is received at the site of further forming such as stamping or pressing, and here a liquid hydrocarbon lubricating oil coating is used in the further forming of the object into a desired shape for the purposes of reducing friction, preventing seizure or burning, preventing press streaks and reducing abrasion of the mold or die. It is believed by many technicians to be desirable to remove the rust-preventive oil before applying the liquid hydrocarbon lubricating oil coating, and this is commonly practiced.

Petroleum lubricating oils which have been used as the working coatings for the purposes described above have relatively and notoriously poor oil film strength, and therefore efforts have been made in the past to improve the oil film strength by adding to the petroleum oil an oil-soluble substance having a polar radical such as a fatty acid, a higher alcohol or an ester. However, even when such an additive has been incorporated, the liquid hydrocarbon lubricating oils which constitute the main component of prior plastic working agents retain or acquire undesirable characteristics; for example, steel plates so coated adhere closely together, dust sticks tightly to the surfaces and the oils of coatings flow during storage making it difficult to maintain a suitable oil film thickness.

On the other hand natural waxes of animal or vegetable origin such as beeswax or montan wax have fewer disadvantages than those possessed by liquid hydrocarbon lubricating oils, i.e. they are solid at ordinary storage and handling temperatures and they contain a high amount of esters. However, such natural waxes are expensive and their physical and chemical properties vary widely, because they are natural products. As a consequence, even the expensive natural waxes are not generally adaptable for the above described uses.

SUMMARY OF THE INVENTION

The present invention provides a process for the cold plastic deformation of metals in which there is applied to the metal workpiece a coating composition consisting of 95 to 20 wt. of a di-long chain aliphatic hydrocarbon ketone of the formula

R'COR'' and about 5 to 80 wt. % of a paraffin that is solid at room temperatures.

In the formula above R' and R'' can be the same or different saturated or unsaturated hydrocarbon radicals of 5 to 25 carbon atoms, preferably a group of 9 to 21 carbon atoms having two or less double bonds.

The above ketones are known in the art and can be prepared generally from two molecular quantities of a fatty acid of 6 to 26 carbon atoms by known decarboxylation methods, that is, by pyrolysis of metal salts. If two molecules of fatty acid are different from each other, e.g. R'COOH and R''COOH, the resulting di-long chain ketone product is a mixture of R'COR', R''COR'' and R'COR''. (Refer, for example, to Kirk-Othmer Encyclopedia of Chemical Technology, Vol. 12, pages 124 and 125.)

The ketones can be used in their purified forms, but it is unnecessary to purify or separate the ketones from the ketonization reaction mixture by removing unreacted fatty acids from the final reaction mixture. Thus a proportion of the starting acids R'COOH or R'λ 'COOH (or both), which is usually less than 8 wt.%, can be left unreacted. Alternatively, additional long chain fatty acid can be incorporated into the reaction product specially. In such cases, the amount of long chain fatty acid in the final composition can be up to 35 wt.%.

In the cases where the ketonization reaction product is used as the ketone component, which can contain free fatty acid up to 35 wt.%, it is the total reaction product including the fatty acid that constitutes the di-long chain aliphatic ketone component range of 95 to 20 wt.% of the total coating composition.

The solid paraffin component is in the range of 110 paraffin to 145 paraffin as described in the specification of JIS K 2235–1961 or a paraffin having equivalent properties. These solid paraffins have melting points above about 43°C.

As previously stated, the proportion of solid paraffin to di-long chain aliphatic ketone component is in the range of about 5/95 to about 80/20. If the amount of solid paraffin is less than the above named range, the spreading and adhering properties of the composition are poor, and the efficiency of the coating deteriorates with repeated working. If the amount of solid paraffin is greater than the above range, the oiliness of the composition is reduced and its coefficient of friction is excessive.

The novel composition of this invention as described above can also contain minor amounts of (1) polybutene (2) lecithin or (3) dialkyl phthalates or dialkyl adipates; or mixtures of (1), (2) and/or (3). These minor ingredients have the effect of improving the homogeneity of the novel composition or its workability when being applied as a coating. Each of (1), (2) and (3) can range up to 25 wt.% of the total composition, but the total of (1), (2) and (3) should be also less than 25 wt.% of the total composition.

Polybutene can be incorporated into the compositions to adjust and improve the viscosity of the final composition to render it suitable for use in a coating device in the melt application of the novel composition. The preferred degree of polymerization of polybutene is in the range of 100 to 2,500.

Lecithin prevents oxidation of the applied coating owing to its antioxidative properties, and is also a viscosity regulating agent like polybutene. Lecithin also acts to reduce the melting point of the novel composition and to prevent excessive slip, and thus prevent stacked sheets or plates from falling or moving laterally during storage.

Dialkyl phthalates and dialkyl adipates have an affinity for both di-long chain aliphatic ketones (R'COR'') and solid paraffins, and therefore prevent segregation of these two major components in the melt mixing thereof and also in the solidification thereof by cooling.

The present invention will be illustrated by way of examples.

EXAMPLE 1

Di-long chain alkyl ketones were prepared from the following fatty acids:

Table 1

| Di-long chain alkylketone Sample No. | m.p. | Starting fatty acid |
|---|---|---|
| 1 | 31 | Caproic acid |
| 2 | 42 | Caprylic acid |
| 3 | 59 | Capric acid |
| 4 | 69 | Lauric acid |
| 5 | 79 | Myristic acid |
| 6 | 87 | Palmitic acid |
| 7 | 89 | Stearic acid |
| 8 | 36 | Oleic acid |
| 9 | 81 | 10% of caproic acid and 90% of stearic Acid |
| 10 | 35 | 90% of caproic acid and 10% of stearic acid |
| 11 | 54 | 50% of caproic acid and 50% of stearic acid |
| 12 | 34 | 90% of caproic acid and 10% of $C_{20}$ acid |
| 13 | 35 | 90% of caproic acid and 10% of $C_{22}$ acid |
| 14 | 85 | 10% of lauric acid and 90% of stearic acid |
| 15 | 82 | 10% of lauric acid and 90% of palmitic acid |
| 16 | 76 | 10% of lauric acid and 90% of myristic acid |
| 17 | 35 | 10% of lauric acid and 90% of oleic acid |
| 18 | 35 | 10% of lauric acid and 90% of linolic acid |
| 19 | 49 | 50% of lauric acid and 50% of capric acid |
| 20 | 44 | 50% of lauric acid and 50% Of caproic acid |
| 21 | 58 | 50% of lauric acid and 50% of capric acid |
| 22 | 68 | 50% of lauric acid and 50% of myristic acid |
| 23 | 73 | 50% of lauric acid and 50% of palmitic acid |
| 24 | 73 | 50% of lauric acid and 50% of stearic acid |
| 25 | 35 | 50% of lauric acid and 50% of oleic acid |
| 26 | 34 | 50% of lauric acid and 50% Of linolic acid |
| 27 | 58 | 50% of lauric acid and 50% of $C_{20}$ acid |
| 28 | 64 | 50% of lauric acid and 50% of $C_{22}$ acid |
| 29 | 68 | 10% of myristic acid and 90% of lauric acid |
| 30 | 83 | 10% of myristic acid and 90% of palmitic acid |
| 31 | 86 | 10% of myristic acid and 90% of stearic acid |
| 32 | 68 | 50% of myristic acid and 50% of lauric acid |
| 33 | 75 | 50% of myristic acid and 50% of palmitic acid |
| 34 | 78 | 50% of myristic acid and 50% of stearic acid |
| 35 | 78 | 90% of myristic acid and 10% of palmitic acid |
| 36 | 78 | 90% of myristic acid and 10% of stearic acid |
| 37 | 79 | 90% of myristic acid and 10% Of oleic acid |
| 38 | 58 | 90% of myristic acid and 10% of palmitoleic acid |
| 39 | 54 | 5% of stearic acid and 95% Of oleic acid |
| 40 | 32 | 10% of stearic acid and 90% of oleic acid |
| 41 | 33 | 25% of stearic acid and 75% of oleic acid |
| 42 | 37 | 50% of stearic acid and 50% of oleic acid |
| 43* | 44 | 65% of stearic acid and 35% of oleic acid |
| 44* | 68 | 80% of stearic acid and 20% of oleic acid |
| 45 | 84 | 95% of stearic acid and 5% of oleic acid |
| 46 | 65 | coconut oil fatty acids |
| 47 | 62 | Beef tallow fatty acids (iodine value; 36.4) |
| 48 | 66 | Hardened beef tallow fatty acids (iodine value; 30) |
| 49* | 71 | Hardened beef tallow fatty acids (iodine value; 25) |
| 50 | 73 | Hardened beef tallow fatty acids (iodine value; 20) |
| 51 | 78 | Hardened beef tallow fatty acids (iodine value; 10) |
| 52 | 82 | Hardened beef tallow fatty acids (iodine value; 5) |
| 53 | 67 | Palm oil fatty acids |
| 54 | 43 | Sperm oil fatty acids |
| 55 | 38 | Rice bran oil fatty acids |
| 56 | 44 | Castor oil fatty acids |

*Samples Nos. 43, 44 and 49 contain 10%, 20% and 33% of fatty acids by adding suitable amounts of the starting fatty acids to the reaction products, respectively.

The method of preparation of the above di-long chain aliphatic ketones was as follows:

Step 1

Charge the starting fatty acid (pure or mixture) and magnesium carbonate into a reaction vessel. The mol ratio of magnesium carbonate to the starting fatty acid is made about 10 mol per 1 mol of fatty acid based on the average molecular weight determined by the neutralization number of the starting fatty acid.

When the fatty acid is a mixture mainly consisting of $C_{16}$ and $C_{18}$ fatty acids, as referred to in Table 1, (Samples Nos. 39 through 45, and 47 through 53,) of which the neutralization number is about 200, the weight ratio is about 25 of magnesium carbonate to 90 of the fatty acid.

Step 2

Heat the mixture to about 340°C and maintain this temperature. Within about 30 minutes, substantially all fatty acid of initial charge described in the above step 1, is converted to the di-long chain alkyl ketone by the reaction described below:

-continued

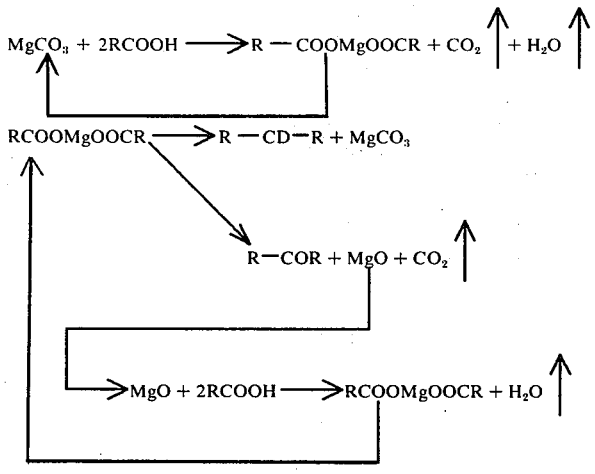

Step 3

At the end of the ketonization reaction of the Step 2, magnesium remains in the vessel as magnesium carbonate and magnesium oxide. It is possible to charge additional fatty acid in an amount of one-fourth to one-fifth by weight of the initial charge at a time. Interval of such additional charges of the fatty acid is made to be 15 to 20 minutes. If the interval is shorter than 15 minutes, unreacted fatty acid will accumulate in the vessel.

Step 4

30 to 35 times of such additional charge of the fatty acid causes the dilution of the catalyst (magnesium carbonate) and reduces the reaction rate considerably. It is a general practice to stop additional charge of the fatty acid at this point and go to the Step 5 to remove magnesium carbonate.

Step 5

Cool the reaction mixture down to about 100°C and then transfer the mixture into the separation vessel, which is made of stainless steel or glasslined so as to be resistant to a diluted solution of inorganic acid such as hydrochloric or sulfuric acid.

Charge an aqueous solution of hydrochloric or sulfuric acid into the separation vessel. Mix the acid solution and the reaction mixture and then stop the mixing. The mixture is allowed to stand to separate an aqueous layer. Magnesium carbonate reacts with the inorganic acid to form magnesium chloride or magnesium sulfate which are soluble into water. Thus, the magnesium is extracted into the aqueous layer and removed from the reaction mixture.

This extraction process should be repeated until the magnesium is removed completely.

At the end of the Step 5, the purity of the ketone is usually more than 95% by weight. If a higher purity is desirable, unreacted fatty acid can be extracted by an aqueous solution of sodium hydroxide, potassium hydroxide, ammonium hydroxide, etc., but for the purpose of this invention, this purification process is unnecessary. Therefore, in preparing the samples of dilong chain alkylketones in Table 1, no purification for removing unreacted fatty acids is conducted.

a. Coefficient of friction:

A SODA's friction tester of the pendulum type was used. Bearing balls and test pieces (pins of 2 mm$\phi$ × 28 mm) were immersed in the test material. A 200 g weight was attached to the pendulum. The pendulum was set slant to give an initial amplitude of 0.5 radian. The coefficient of friction was calculated from the reduction of amplitude damped by the friction between the pins and balls. Among the test materials, solid paraffin, di-long chain aliphatic ketone, and stearic acid were used in the form of a 0.3% solution in kerosene. As liquid mineral oils, spindle oil, neutral oil, machine oil and liquid paraffin were used.

The results are given in Table 2, below.

Table 2

| Test material | Range of coefficient of friction |
|---|---|
| Di-long chain aliphatic ketones Nos. 1–56 | 0.11–0.14 |
| Solid paraffin (m.p. 45°C) | 0.35–0.4 |
| Stearic acid | 0.09–0.10 |
| Liquid mineral oil | 0.18–0.22 |

*The average of 10 measurements per one sample is taken and the coefficient of friction calculated from such average falls in the ranges shown in Table 2.

It is apparent from the above table that the dilong chain aliphatic ketones have excellent oiliness and lubricating property i.e. as a class they have an excellent low coefficient of friction.

b. Spreading property

A SODA's tester of the pendulum type was used. Unlike the above evaluation of the coefficient of friction wherein the test pieces (pins and bearing balls) were immersed in a test material, in this test the test pieces (pins and bearing balls) were immersed in a 2% solution of a test material in toluene. Then they were taken out with tweezers and air-dried. Thereafter, the reduction of amplitude by friction was measured. From the amplitude, the coefficient of friction was calculated to indicate the spreading property. The test was repeated 10 times. In this case, full recovery of film is not expected and, therefore, the coefficient of friction increases gradually if the resistance of test material to the removal by friction is not satisfactory.

Evaluation Standards for Spreading Property

A: Coefficient of friction in the 10th test is below 0.15.

B: Coefficient of friction in the 10th test is 0.15–0.18.

C: Coefficient of friction in the 10th test is 0.18–0.22.

D: Coefficient of friction in the 10th test is 0.22–0.25, coefficient does not exceed 0.25 during the 10 times repetition of the test, and the coefficient in the 5th test is not higher than 0.20.

E: Coefficient of friction in the 10th test is not higher than 0.25 and the coefficient in the first test is not less than 0.15, oiliness thereof being somewhat poor.

F: Unsuitable for plastic working agent. The rest results were as shown in Tables 3 and 4.

Table 3

| Test material | Coefficient of friction 1st test | 5th test | 10th test | Spreading property |
|---|---|---|---|---|
| Di-long chain aliphatic ketone No. 7 | 0.11 | 0.16 | 0.30 | F |
| Solid paraffin (m.p. 45°C) | 0.29 | 0.29 | 0.36 | F |
| Stearic acid | 0.09 | 0.24 | 0.45 | F |

Table 4

| Di-long chain aliphatic ketone Sample No. | Spreading property: Content of solid paraffin* (wt. %) 0 | 2 | 5 | 15 | 40 | 75 | 85 |
|---|---|---|---|---|---|---|---|
| 1 | E | D | C | B | B | D | E |
| 2 | E | D | B | A | C | D | E |
| 3 | E | D | D | B | B | D | E |
| 4 | D | D | D | B | B | D | E |
| 5 | D | B | B | B | B | D | D |
| 6 | F | C | A | A | D | D | D |
| 7 | F | B | A | A | A | D | D |
| 8 | D | D | C | C | C | C | C |
| 9 | C | A | A | B | C | C | D |
| 10 | E | D | C | B | C | D | E |
| 11 | D | B | C | C | C | C | E |
| 12 | D | B | A | A | B | C | D |
| 13 | D | B | A | A | B | C | C |
| 14 | D | B | A | B | C | C | C |
| 15 | D | B | A | B | C | D | D |
| 16 | C | B | A | B | B | B | C |
| 17 | D | C | B | D | D | D | E |
| 18 | E | C | C | C | D | D | E |
| 19 | E | D | C | D | D | D | D |
| 20 | E | D | C | C | D | D | D |
| 21 | E | D | B | C | D | D | D |
| 22 | D | B | B | B | B | B | C |

Table 4-continued

| Di-long chain aliphatic ketone Sample No. | Spreading property: Content of solid paraffin* (wt. %) 0 | 2 | 5 | 15 | 40 | 75 | 85 |
|---|---|---|---|---|---|---|---|
| 23 | D | A | A | B | B | B | B |
| 24 | D | A | A | B | B | B | B |
| 25 | D | B | A | B | C | C | D |
| 26 | E | E | D | B | D | D | E |
| 27 | D | B | A | A | B | C | C |
| 28 | D | C | C | A | B | C | C |
| 29 | D | B | B | B | B | B | C |
| 30 | D | B | A | A | A | D | D |
| 31 | D | A | A | B | B | C | C |
| 32 | D | B | B | B | B | C | C |
| 33 | D | B | B | B | B | B | C |
| 34 | D | B | B | B | B | D | D |
| 35 | D | B | B | B | B | D | D |
| 36 | D | B | B | B | B | D | E |
| 37 | D | B | A | A | A | D | D |
| 38 | D | B | B | B | B | D | E |
| 39 | E | D | B | C | C | D | D |
| 40 | E | D | C | B | C | C | D |
| 41 | D | B | A | A | B | C | C |
| 42 | F | A | A | B | B | B | C |
| 43 | F | B | A | A | B | C | D |
| 44 | F | B | A | A | A | B | C |
| 45 | F | B | A | A | A | A | A |
| 46 | E | D | C | D | D | D | D |
| 47 | E | D | C | C | D | D | D |
| 48 | E | D | C | C | D | D | D |
| 49 | F | C | A | A | B | B | C |
| 50 | F | B | A | A | B | B | B |
| 51 | F | B | A | A | A | B | B |
| 52 | F | B | A | A | A | C | C |
| 53 | E | C | B | B | B | B | C |
| 54 | E | C | B | B | C | C | C |
| 55 | E | C | B | B | B | C | C |
| 56 | E | C | B | B | B | C | C |

*Melting points of the solid paraffins used were 44°C for di-long chain aliphatic ketone samples Nos. 1–12; 54°C for Nos. 13–28; 59°C for Nos. 29–45 and 68°C for Nos. 46–56.

The results shown in Tables 3 and 4 show that the spreading property is improved by incorporating solid paraffin in a dilong chain aliphatic ketone.

c. Rust preventive property i. A novel coating composition of the invention was dissolved in benzene to obtain a 2 wt. % solution. A cold-rolled steel plate SPC-E (50 × 100 × 1.0 mm, JIS G-3141) which had been deoiled or defatted and washed, was immersed in the solution for 30 seconds, taken out, air-dried and allowed to stand at 40°C in an atmosphere of 98–100% humidity. The time required for 20% or more of the surface area of the steel plate to be covered by rust was measured.

The results are shown in Table 5.

Table 5

| Test Group | Novel coating composition: Di-long chain aliphatic ketone Sample No. (refer to Table 1) | Solid paraffin (hr.) | Rusting time |
|---|---|---|---|
| A | 95% of each of samples Nos. 1, 2, 3, 10, 12, 13, 17, 18, 25, 26, 37, 38, 39, 40, 41, 53, 54, 55 and 56 | 5% of solid paraffin of m.p. 68°C | 26–36 |
| B | 80% of each sample but excluding those included in group A | 20% of solid paraffin of m.p. 44°C | 28–108 |
| C | 70% of each sample of group A | 30% of solid paraffin of m.p. 59°C | 32–96 |
| D | 50% of each sample of group B and 5% of each of polybutene, lecithin and dinonyl adipate | 35% of solid paraffin of m.p. 54°C | 32–96 |
| E | 25% of each sample of group A, 10% of polybutene, 5% of lecithin and 5% of stearic acid | 55% of solid paraffin of m.p. 68°C | 36–144 |
| F | 20% of each sample of group B, 10% of polybutene, 5% of lecithin and 5% of stearic acid | 60% of solid paraffin of m.p. 68°C | 32– 144 |
| G | None (control) | 100% of solid paraffin of m.p. 68°C | 16–24 |
| H | None (control) | None (control) | 0.1–6.0 |

As shown in Table 5, all novel coating compositions of the present invention have excellent rust preventive properties. Though the solid paraffins alone also exhibit considerable rust preventive properties, the novel compositions are clearly superior.

ii. A novel coating composition of the invention was applied in a thickness of 2–5$\mu$ onto a cold-rolled steel disc SPC-EC. The disc was pressed into the shape of a cup of 36 mm inside diameter and 15 mm depth. The cup was allowed to stand at room temperature for 20 days and the area of the rusted portion was measured. The results were as shown in Table 6.

Table 6

| Novel coating composition | | | Area of rusted portion |
|---|---|---|---|
| Test group | A | in Table 5 | 0–6% |
| " | B | " | 0–2 |
| " | C | " | 0–6 |
| " | D | " | 3–8 |
| " | E | " | 2–10 |
| " | F | " | 2–8 |
| " | G | " (control) | 9–27 |
| " | H | " (control) | 95 |

The fact that the compositions of the invention exhibit excellent rust preventive effects on the pressed cups shows that the compositions form a lubricating film sufficiently proof against the pressing, i.e. a lubricating film of excellent spreading and adhering property.

d. Rolling property

Rolling property was evaluated from the conical cup value (CCV) and the limit decrement ratio (LDR).

The conical cup value was determined by using 17 type punch dies according to the specification of JIS Z 2249.

The limit decrement ratio which is a ratio of D/*d*, where D is a diameter of the blank plate and d is an inside diameter of a resultant cup, was determined by means of twelve punches with diameters varied from 29.0 mm to 40.0 mm in increments of 1 mm, twelve corresponsing dies, and six SPE-E steel plates with diameters varied from 69.0 mm to 74.0 mm in increments of 1 mm and with a thickness of 1.0 mm. The combinations of these 12 sets of punch-dies with 6 dimensions of circular discs permitted 72 DR's (decrement ratios) to cover a range of 1,725–2,552. The differences of DR ranged from 0.01 to 0.03. Five discs were employed for one DR, and thus LDR was defined as the DR with which four discs could be formed to a cup.

The results of the evaluation are shown in Table 7. Smaller CCV and larger LDR indicate better results. In general, a CCV of less than 38.3 and a LDR of more than 2.10 are practically desirable.

In groups A–F in Table 7, the di-long chain aliphatic ketcnes were obtained from fatty acids of less than 10 carbon atoms inclusive, having somewhat low oiliness or from fatty acids having double bond unsaturation. The compositions of said groups (except group E wherein 85% of solid paraffin is contained) have excellent plastic working properties.

Table 7

| Test Group | Novel coating composition Di-long chain aliphatic ketone sample No. (refer to Table 1) | Solid paraffin | Rolling Property CCV | LDR |
|---|---|---|---|---|
| A | 95% of each samples Nos. 1, 2, 3, 10, 12, 13, 17, 18, 25, 26, 37, 38, 39, 40, 41, 53, 54, 55 and 56 | m.p. 68°C 5% | 37.74–37.96 | 2.16–2.19 |
| B | 75% of each sample of group A | m.p. 68°C 25% | 37.72–37.96 | — |
| C | 70% of each sample of group A, 5% of lecithin and 5% of polybutene | m.p. 58°C 20% | 37.74–37.96 | 2.17–2.19 |
| D | 50% of each sample of group A, 5% of lecithin, 5% of polybutene and 5% of ditridecyl phthalate | m.p. 44°C 35% | 37.96–38.14 | 2.14–2.16 |
| E | 10% of each sample of group A and 5% of polybutene | m.p. 44°C 85% | 38.30–38.80 | 2.00–2.05 |
| F | 50% of each sample of group A, 5% of lecithin and 5% of dinonyl adipate | m.p. 48°C 40% | 37.98–38.18 | 2.14–2.18 |
| G | 95% of each of samples Nos. 4, 5, 6, 7, 8, 9, 11, 14, 15, 16, 19, 20, 21, 22, 23, 24, 27–36, 42–52 | m.p. 58°C 5% | 37.60–37.81 | 2.18–2.30 |
| H | 50% of each sample of group G | m.p. 58°C 50% | 37.76–38.62 | 1.96–2.19 |
| | None (control) | m.p. 54°C 100% | 38.34 | 1.88 |
| I | 60 spindle oil | None (control) | 38.84 | 1.84 |
| | special No. 2 machine oil | | 38.20 | 1.98 |
| | Caproic acid | | 38.44 | 2.01 |
| | Stearic acid | | 37.52 | 2.14 |
| | No application | | 39.13 | 1.80 |

In groups G and H in Table 7, oiliness is excellent. Though, with only di-long chain aliphatic ketone, the spreading property is somewhat low, it is shown that the spreading property is improved by incorporating solid paraffin therein. In group H, the majority gave a CCV of less than 38.3 and a LDR of higher than 2.10. There is no composition in group H which exhibits a CCV of higher than 38.3 and LDR of less than 2.10 at the same time.

Group I in Table 7 relates to control or comparative examples. Though the rolling property is improved by applying those substances, 60 spindle oil and Special No. 2 machine oil are liquid having the above described defects, and they have low LDR. Caproic acid is too low in melting point for its use in summer and, moreover, it has a strong odor, a poor rust preventive property, a high CCV and a low LDR. Though stearic acid is excellent as a solid rolling agent, the spreading property thereof is poor as shown in Table 3. Steel plates coated with stearic acid have an excessive lubricity and a stack of them is apt to move laterally or fall down during storage. Thus, stearic acid is also impractical.

e. Welding and soldering properties

In general, a plastic working agent has conventionally been removed by washing after a shaping process and before the next process step. However, it is highly desirable from a practical standpoint to omit the washing step, because the step of removing the plastic working agent is expensive, and the washing treatment causes rusting and discoloration of metal materials. In this test, steel plates coated with the coating compositions were subjected to a welding test and a soldering test.

In the welding test, two SPC-E steel plates (coated or uncoated of 15 mm width, 60 mm length and 1.0 mm thickness were placed in such a manner that an edge (10 mm) of one plate is put into contact with an edge of the other between two conical copper electrodes of a bottom diameter of 25 mm, top diameter of 1.5 mm and vertical angle of 60°, the central part of the overlapped part being sandwiched between the electrodes. Thereafter, an electric current of 3,000 A (AC 50 C/S) (1V) was applied for 0.5 or 1.0 second to effect the welding. After the welding, the joined plates were stretched in the longitudinal direction till breakage. Rupture strength was calculated from the tensile power and area of welding. Soldering:

Two test pieces of 30 mm width were coated, and soldered in such a manner that an edge (10mm) of a plate is put on an edge of the other. Thus joined plates were stretched, and the breaking load was determined.

In judging the data shown in Table 8, a rupture strength higher than 90% of that of a case of non-coated surface is considered to be not different practically, since the plate materials per se have a considerable deviation. In most cases, the coating compositions of the present invention exhibit a higher rupture strength than uncoated plate. As for the soldered plates, the strength is equivalent in both coated and uncoated cases. This phenomenon is concluded to be owing to the fact that the compositions of the present invention act as solder fluxes.

Table 8

| Novel coating composition | Coating condition* | Welding property (Rupture strength kg/mm²) Welding time 0.5 sec. | Welding time 1.0 sec. | Breaking load of soldered plates (kg) |
|---|---|---|---|---|
| Group A in Table 7 | A | 30.0–34.3 | 30.5–37.0 | 530–580 |
| " B " | A | 31.4–35.4 | 31.7–36.6 | " |
| " C " | A | 33.5–35.4 | 32.7–38.1 | " |
| " D " | A | 31.6–34.2 | 32.4–37.6 | " |
| " E " | A | 29.4–35.2 | 31.4–34.6 | 470–520 |
| " F " | A | 29.7–33.4 | 31.5–36.7 | 550–660 |
| " G " | A | 30.6–32.8 | 32.9–37.4 | 520–580 |
| " H " | A | 32.1–35.5 | 33.9–38.5 | " |
| Paraffin m.p. 54°C | A | 31.7–33.5 | 32.3–36.5 | soldering impossible |
| None | — | 29.3 | 33.3 | 550±50 |
| 100 Spindle oil | B | 17.4 | 19.6 | soldering impossible |
| Special No. 2 machine oil | B | 10.5 | 18.2 | " |
| Special No. 2 machine oil | C | welding impossible | welding impossible | " |

*Coating conditions:
A: A coating composition is dissolved in toluene to obtain 2% solution. Test pieces are immersed in the solution, taken out and dried by blowing air at 80°C for 30 seconds.
B: Test pieces are immersed in spindle oil or special No. 2 machine oil, taken out and treated in the same manner as in A.
C: Special No. 2 machine oil is applied to test pieces with a brush.

The embodiments of the invention in which an exclusive property or privelege is claimed are defined as follows:

1. In a process which comprises effecting cold plastic deformation of a deformable metal workpiece, the improvement which comprises: coating said metal workpiece, prior to the cold plastic deformation thereof, with an adherent solid film of a composition consisting essentially of a mixture of (A) from 95 to 20 percent by weight of a ketone component consisting of a ketone or a mixture of ketones having the formula R'COR'', wherein R' and R'', which can be the same or different, are saturated or unsaturated aliphatic hydrocarbon radicals having 5 to 25 carbon atoms, provided that each of R' and R'' has zero to 2 double bonds, said ketone component containing up to 35 weight percent of free fatty acids having the formulas R'COOH and R''COOH, wherein R' and R'' have the same meanings as defined above, (B) from 5 to 80 percent by weight of paraffin having a melting point higher than about 43°C, and (C) from zero to 25 percent by weight of a material selected from the group consisting of polybutene, lecithin, dialkyl phthalates, dialkyl adipates and mixtures thereof.

2. A process as claimed in claim 1 in which said adherent solid film is formed by applying a melt of said composition as a molten film on said workpiece and then cooling said molten film to transform same to said adherent solid film.

3. A process as claimed in claim 1 in which said adherent solid film is formed by applying a solution of said composition in an organic solvent as a liquid film on said workpiece and then drying said liquid film to transform same to said adherent solid film.

4. A process of claim 1, wherein R′ and R″ are aliphatic hydrocarbon radicals having 9 to 21 carbon atoms and having two or less double bonds.

* * * * *